US006994818B2

(12) United States Patent
Keller

(10) Patent No.: US 6,994,818 B2
(45) Date of Patent: Feb. 7, 2006

(54) METHOD OF MAKING A MULTIPLE CHAMBER TUBE

(75) Inventor: Gerhard Keller, Jongny (CH)

(73) Assignee: Aisapack Holding S.A., Vouvry (CH)

( * ) Notice: Subject to any disclaimer, the term of this patent is extended or adjusted under 35 U.S.C. 154(b) by 259 days.

(21) Appl. No.: 10/451,472

(22) PCT Filed: Dec. 18, 2001

(86) PCT No.: PCT/EP01/14950

§ 371 (c)(1),
(2), (4) Date: Jun. 18, 2003

(87) PCT Pub. No.: WO02/051717

PCT Pub. Date: Jul. 4, 2002

(65) Prior Publication Data

US 2004/0026822 A1 Feb. 12, 2004

(30) Foreign Application Priority Data

Dec. 19, 2000 (DE) ..... 100 63 211

(51) Int. Cl.
*B29C 65/70* (2006.01)

(52) U.S. Cl. ..... 264/248; 264/250; 264/255

(58) Field of Classification Search ..... 264/248, 264/250, 255
See application file for complete search history.

(56) References Cited

U.S. PATENT DOCUMENTS

| | | | | |
|---|---|---|---|---|
| 3,081,926 | A * | 3/1963 | Newton | 229/5.6 |
| 5,102,016 | A * | 4/1992 | Ball et al. | 222/145.3 |
| 5,154,917 | A * | 10/1992 | Ibrahim et al. | 424/44 |
| 5,219,373 | A | 6/1993 | Hatakeyama et al. | |
| 5,823,391 | A | 10/1998 | Klauke et al. | |
| 5,865,345 | A * | 2/1999 | Cistone et al. | 222/94 |
| 5,954,231 | A * | 9/1999 | Durliat et al. | 222/1 |
| 6,227,837 | B1 * | 5/2001 | Keller et al. | 425/112 |

FOREIGN PATENT DOCUMENTS

| | | |
|---|---|---|
| DE | 195 47 957 | 7/1997 |
| DE | 199 11 728 | 9/2000 |
| EP | 1 010 643 | 6/2000 |
| WO | WO 94 19251 | 9/1994 |

* cited by examiner

*Primary Examiner*—Edmund H. Lee
(74) *Attorney, Agent, or Firm*—Collard & Roe, P.C.

(57) ABSTRACT

The invention relates to a multi-chamber tube with at least two chambers and a tube head, with closable withdrawal apertures corresponding to the number of chambers and consisting of an accumulation of at least two separately produced tubular pipes arranged parallel to one another with a rounded external periphery common to all tubular pipes. According to the invention it comprises an integral tube head produced by pressed molten portions and common to all tubular pipes and containing the partition walls corresponding to the number of tubular pipes and connected thereto, molten material simultaneously flowing around the edge ends of the tubular members which are rigidly connected to one another after curing.

3 Claims, 1 Drawing Sheet

METHOD OF MAKING A MULTIPLE CHAMBER TUBE

CROSS REFERENCE TO RELATED APPLICATIONS

Applicant claims priority under 35 U.S.C. §119 of German Application No. 100 63 211.4, filed: Dec. 19, 2000. Applicant also claims priority under 35 U.S.C. §365 of PCT/EP01/14950, filed: Dec. 18, 2001. The international application under PCT article 21(2) was not published in English.

The invention relates to a multi-chamber tube with at least two chambers and a tube head, with closable withdrawal apertures corresponding to the number of chambers and consisting of an accumulation of at least two separately produced tubular pipes arranged parallel to one another with a rounded external periphery common to all tubular pipes.

A two chamber tube of this type is known from WO 94/19251. This tube consists of a plurality of separately produced individual tubes, each with a tube head with an outlet aperture, which are held together by a closure member holding them together at one end and a seal at the other end. This multi-chamber tube is expensive to produce as a plurality of separate tubes and an additional closure member holding them together and enclosing all tube heads have to be produced.

The object of the invention is to improve a multi-chamber tube of the type mentioned at the outset so, on the one hand, it can be produced more easily and less expensively, can be held together and yet still has an attractive appearance.

This object is achieved by a multi-chamber tube with the characterising features of claim 1.

A further object of the invention is to provide a method for producing such a multi-chamber tube.

This object is achieved by a method according to claim 2.

Advantageous embodiments of the invention can be taken from the sub-claims.

The invention will be described in more detail hereinafter with the aid of an embodiment and with reference to the drawings, in which.

Figure 1:
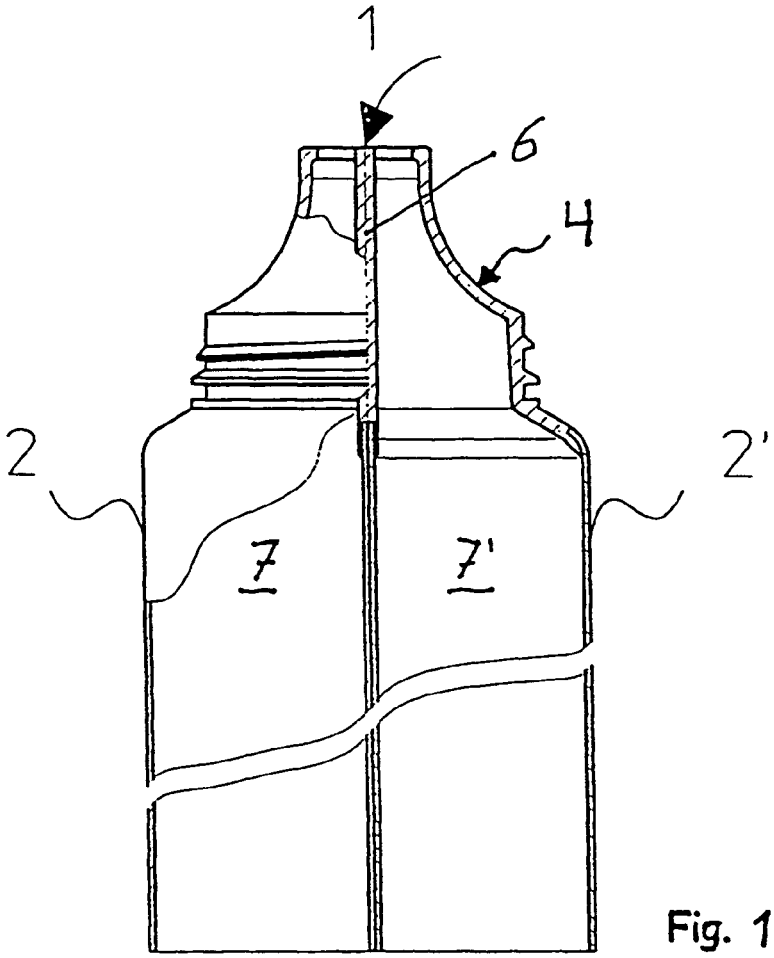
FIG. 1 shows a two chamber tube in partial cross-section.
Figure 2:
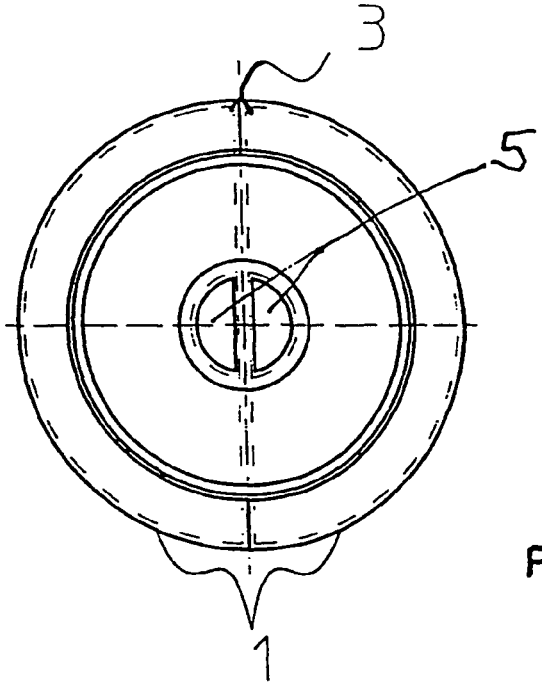
FIG. 2 is a plan view of the multi-chamber tube.

The two chamber tube shown in FIG. 1 as an example of multi-chamber tubes consists of two tubular members 2, 2' produced by any known method with an overlapping longitudinal seam, for example by the method known from DE-C-31 05 146.

The tubular members 2, 2' produced—optionally cut to length—are then axially nicked or notched at two points, the notch lines 3 marking the points in the tubular member 2, 2' at which a bend is to be made from the produced round shape to form a, in the embodiment, D-shaped tubular member 2, 2'. The notch lines 3 are to be made in such a way that if both tubular members 2, 2' shaped to form a D are placed against one another with their respective straight portions, a rounded external periphery is produced. The external periphery can, for example, be produced so as to be round or also randomly oval. The type of rounding is predetermined in D-shaped tubular members 2, 2' by the spacing of the two notched lines 3.

The notched lines 3 are preferably made by radially adjustable, rotatably mounted notched discs, wherein any damage to the material construction has to be avoided.

The notched tubular members 2, 2' are then, preferably aligned, pushed through a mould plate in which a permanent change to their shape is made, for example for a two chamber tube a shape which is D-shaped in cross-section, the edges of which, limiting the straight portion, being predetermined by the two notch lines 3.

The D-shaped tubular members 2, 2' are then each supplied individually to a respective correspondingly designed mandrel which can preferably be arranged at a distance from one another and are movable relative to one another to draw up the tubular members. Care should be taken when drawing up the tubular members 2, 2' onto the D-shaped mandrels that the seam regions of each tube are located separately from one another, i.e. at a distance from one another on the straight portions of the D-shaped tubular members 2, 2' so there are no overlapping four-fold layers when the tubular members 2, 2' are brought together to form a multi-chamber tube. The D-shaped mandrels spaced apart or pivoted to draw up the tubular members 2, 2' are brought together and supplied jointly to a press moulding station. The tube head 4 with the separated discharge apertures 5 and/or optionally also a plurality of partition walls 6 is produced in the press moulding station by means of one or optionally a plurality of molten material portions. At the same time there is a connection to the two tubular members 2, 2' both at the outer edge and at the partition wall 6 resulting in two chambers 7, 7' which are completely separated from one another. A residual gap at the level of the shoulder contour, connected to the hollow space to form the head shoulder and consequently being filled during the moulding process with material melt, remains between the two tubular member ends supplied to the moulding station, during the slipping-on process. As a result, melt flows around the edge ends of the tubular members 2, 2' and these are rigidly connected to one another upon curing.

As shown above the opposing upper ends of the tubular members 2, 2' are also rigidly connected to one another in the process described. In addition a connection can be made, for example owing to a melting-on or gluing process, along all tubular members forming a multi-chamber tube in any region of the, preferably straight, portions of the respective multi-chamber tubes attached to one another, so, for example, the ends of the tubular members 2, 2' opposing the tube head 4 can be rigidly connected to one another.

If required the finished multi-chamber tubes can even now be cut to length, for example by a rotary blade.

What is claimed is:

1. Method for producing a multi-chamber tube with at least two chambers (7, 7') and a tube head (4), with closeable withdrawal apertures (5) corresponding to the number of chambers (7, 7'), at least two separately produced tubular pipes (2, 2') arranged parallel to one another being manufactured with a common rounded external periphery, comprising:

producing in the number of desired chambers (7, 7') tubular pipes (2, 2') which are drawn onto partial mandrels, bringing the partial mandrels and the tubular pipes (2, 2') together, introducing the partial mandrels brought together with the tubular pipes (2, 2') into a press moulding device and press moulding a plastic portion to produce a tube head (4) with partition walls (6), while simultaneously connecting both the tube head (4) and the partition walls (6) to edge ends of the tubular pipes (2, 2'), which have axial notched edges (3) at least at two spaced apart points wherein, the edge ends of the tubular pipes (2, 2') are also rigidly connected to one another during the press moulding;

the edge ends of the tubular pipes (2, 2') are also rigidly connected to one another during press moulding.

2. Method for producing a multi-chamber tube according to claim 1, wherein the tubular members (2, 2') are shaped along the axial notched edges (3), viewed in cross-section, into partial circle-shaped portions.

3. Method for producing a multi-chamber tube according to claim 1, wherein the tubular pipe sections adjacent to one another are at least partially connected to one another in their longitudinal extension.

* * * * *